US005921433A

United States Patent [19]

Friar et al.

[11] Patent Number: 5,921,433

[45] Date of Patent: Jul. 13, 1999

[54] MEDICATION DISPENSER WITH DISCHARGE CHANNEL FORMED BY OPPOSING DOORS

[75] Inventors: Timothy A. Friar, Columbus; Michael T. Kopczewski, Orient, both of Ohio

[73] Assignee: Medicart, L.L.C., Columbus, Ohio

[21] Appl. No.: 08/993,370

[22] Filed: Dec. 18, 1997

[51] Int. Cl.[6] ..... G07F 11/66; B65H 3/58; B65H 5/238

[52] U.S. Cl. ..... 221/25; 221/26; 221/70

[58] Field of Search ..... 221/25, 26, 70

[56] References Cited

U.S. PATENT DOCUMENTS

| | | | |
|---|---|---|---|
| 1,106,559 | 8/1914 | Hamilton | 221/26 |
| 2,587,928 | 3/1952 | Tuck et al. | 221/25 |
| 2,931,536 | 4/1960 | Thomasma et al. | 221/26 |
| 2,984,397 | 5/1961 | Gillam | 221/25 |
| 3,325,050 | 6/1967 | Wanamaker | 221/25 |
| 4,162,739 | 7/1979 | Nelson | 221/70 |

FOREIGN PATENT DOCUMENTS

| | | | |
|---|---|---|---|
| 760633 | 11/1956 | United Kingdom | 221/70 |

*Primary Examiner*—Kenneth Noland
*Assistant Examiner*—Joe Dillon, Jr.
*Attorney, Agent, or Firm*—Wood, Herron & Evans, LLP

[57] ABSTRACT

A front loading dispenser for dispensing medication pouches in a roll/strip form. The dispenser preferably includes a top door pivotally hinged to the top of the dispenser and a bottom door pivotally hinged to the bottom of the dispenser. Medication pouches in roll/strip form are inserted into the dispenser, and the top and bottom doors are then closed to define a dispensing channel for dispensing of the medication pouches. One of the doors includes a pouch engaging member which extends into the dispensing channel to engage the roll/strip of medication pouches and prevent them from retracting into the dispenser.

17 Claims, 5 Drawing Sheets

MEDICATION DISPENSER WITH DISCHARGE CHANNEL FORMED BY OPPOSING DOORS

FIELD OF THE INVENTION

The present invention relates to a medication dispenser for housing and dispensing continuous strips of medication pouches.

BACKGROUND OF THE INVENTION

With high-speed packaging equipment, medication tablets and capsules can be packaged in plastic pouches in a continuous strip arranged in the sequence in which they should be administered to the patient. These strips of medication pouches have heretofore been handled in various ineffective ways. One common practice was to simply lay these strips, folded or rolled, in an open bin or drawer in a medication cart. In this manner, they can easily get out of sequence and become disorganized, presenting a greater chance of administration error.

The present invention relates to a dispenser container that houses continuous strips of medication pouches in such a way as to insure that the administrator of the medication only has access to the medication pouches in the sequence in which they are intended to be administered. The container is designed such that the next sequenced pouch to advance is visible after removing the current pouch to be administered. A mechanism is provided that prohibits the remaining strip from accidentally retracting into the container. The container includes the patient's name and relevant information. The container is also designed for easy loading by the pharmacist because fast and efficient handling of the strips is absolutely necessary to gain the full benefit of the high-speed packaging machines.

SUMMARY OF THE INVENTION

The unique way in which the container opens and closes to load strips of medication is one of the most important features of the container's design. The container provides for front loading whereby two doors hinge open to allow full access to the inside of the container. One door, i.e., the top door, is hinged at the top of the container opening through which the medication or other article to be dispensed is inserted. The top door is pivotally connected to the container. A bottom door, hinged at the bottom of the opening opposite from the top door, is also pivotally connected to the container. The two doors are sequentially closed after the rolled-up strip of medication pouches is placed inside. The top drawer is closed behind the strip of pouches and the bottom door folds up in front of the strip of pouches, sandwiching the strip between the two doors. This enables the container to eliminate the need to thread the strip through a fixed feeding area. In one embodiment, the top door includes a tension arm fixed to the upper surface of the door which bears transversely against the strip when the two doors are closed. In a second embodiment, the top door includes a resilient retainer affixed thereto which extends from the upper surface of the door and bears against a longitudinal edge of the strip when the two doors are closed. The tension arm and retainer prevent the medication strip from retracting into the container. The bottom door is preferably transparent so that the medication pouch can be viewed when the door is closed. At the top of the container or at any other suitable place a label can be provided which would include the patient's name and other relevant information.

While the containers may be shipped individually, it is preferred from the standpoint of institutional use that the containers be housed in a transport tub which can subsequently be placed into the drawer of a medication cart. A delivery person can exchange the tubs filled with the containers at predetermined intervals to replenish the medication. The tubs house the containers in an upright manner so that the administrator of the medication can quickly identify a patient's container and quickly scan the next available medication pouches to determine their administration times.

While the invention has been and will be further described in the context of medication pouches, it should be noted that the container can be used to house strips of other types of articles as, for example, candies that are packaged in strip form.

BRIEF DESCRIPTION OF THE DRAWINGS

The invention may best be understood in connection with the following drawings wherein.

DETAILED DESCRIPTION OF THE INVENTION

Figure 1:
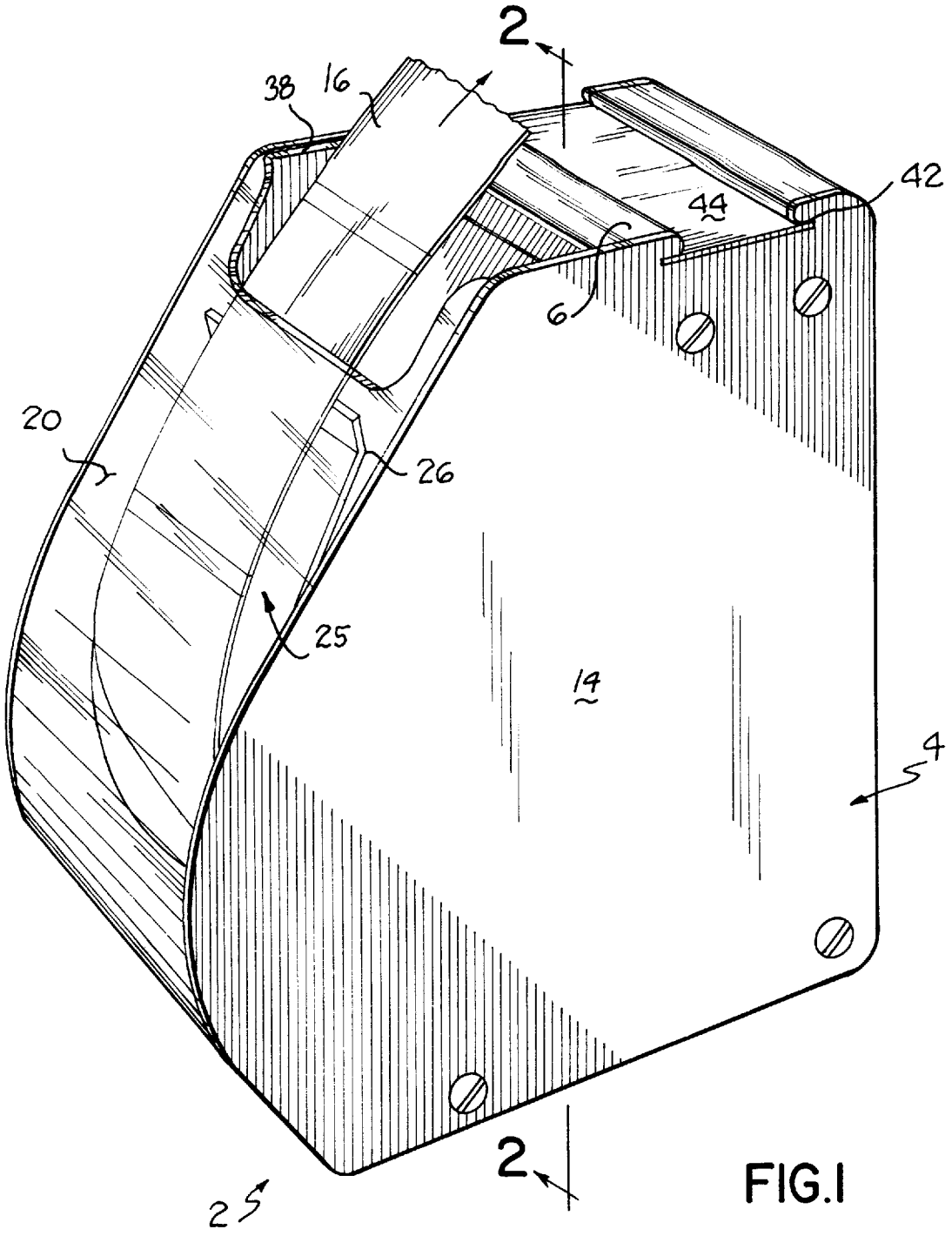
FIG. 1 is a perspective view showing a dispenser in accordance with one embodiment of the present invention, with a roll of medication in roll/strip form inserted.

Referring to the drawings, and to FIGS. 1–5 in particular, one embodiment of a strip dispenser 2 of the present invention includes a container 4 which has a top wall 6, a bottom wall 8, a back wall 10 and side walls 12 and 14. Typically, these are made out of a suitable plastic material and the elements may be individually formed and joined or formed in combination with each other as an integral unit. Suitable means are provided to fasten the elements one to the other.

Products as, for example, medication pouches packaged in a roll/strip 16 form are intended to be dispensed from the container 4. While medication in pouch form has been illustrated, it should be noted that other types of products may be similarly packaged as, for example, candies and the like. When medication is packaged, the individual pouches may contain a plurality of medications for a specific patient.

Figure 2:
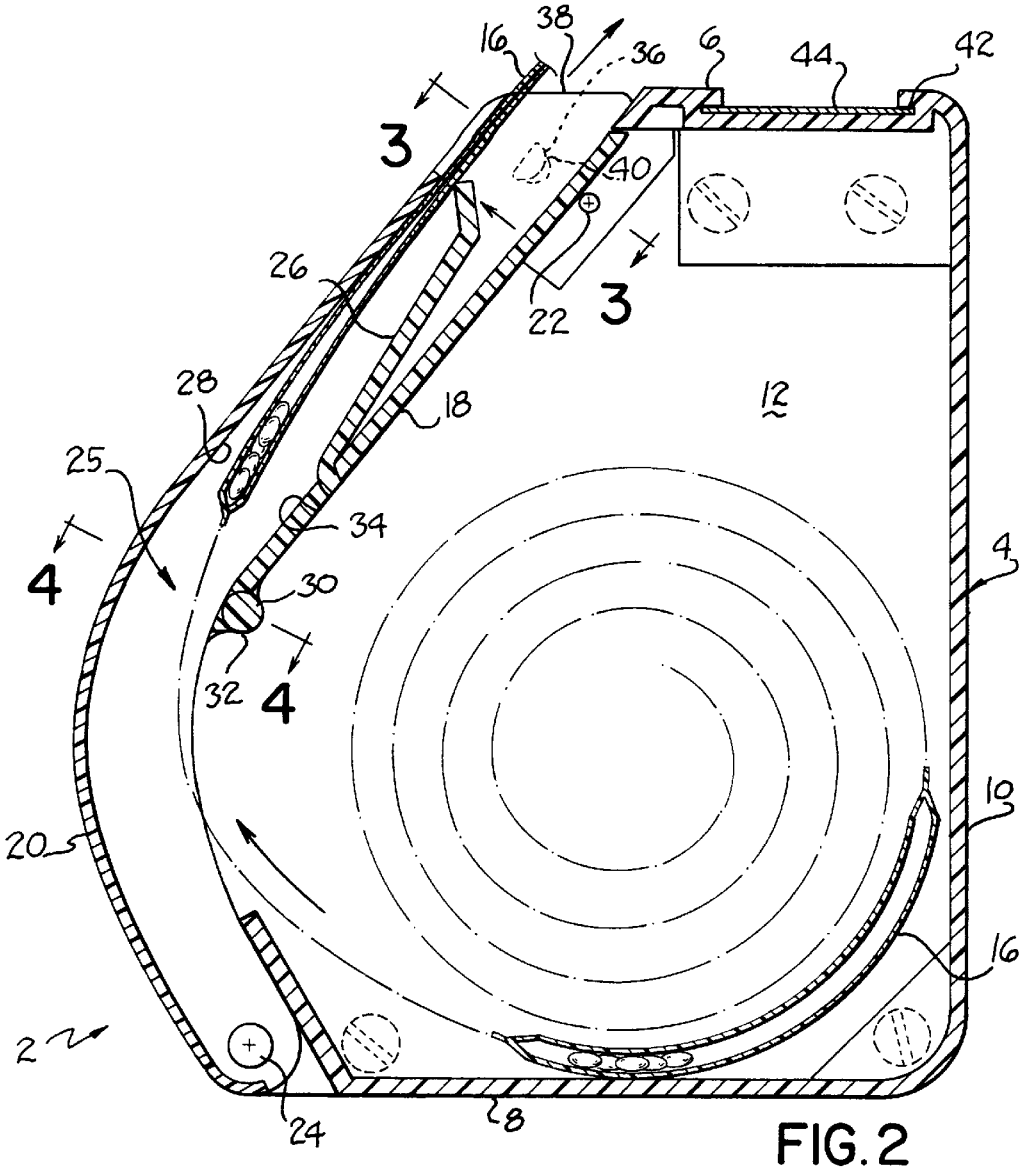
FIG. 2 is a view taken along lines 2—2 of FIG. 1.
Figure 3:
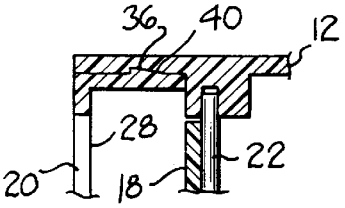
FIG. 3 is a view taken along lines 3—3 of FIG. 2.
Figure 3A:
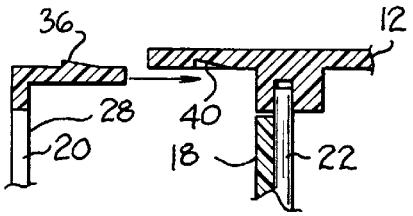
FIG. 3A is a view similar to FIG. 3 but showing the door opened.
Figure 4:
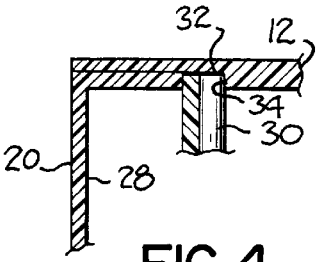
FIG. 4 is a view taken along lines 4—4 of FIG. 2.
Figure 5:
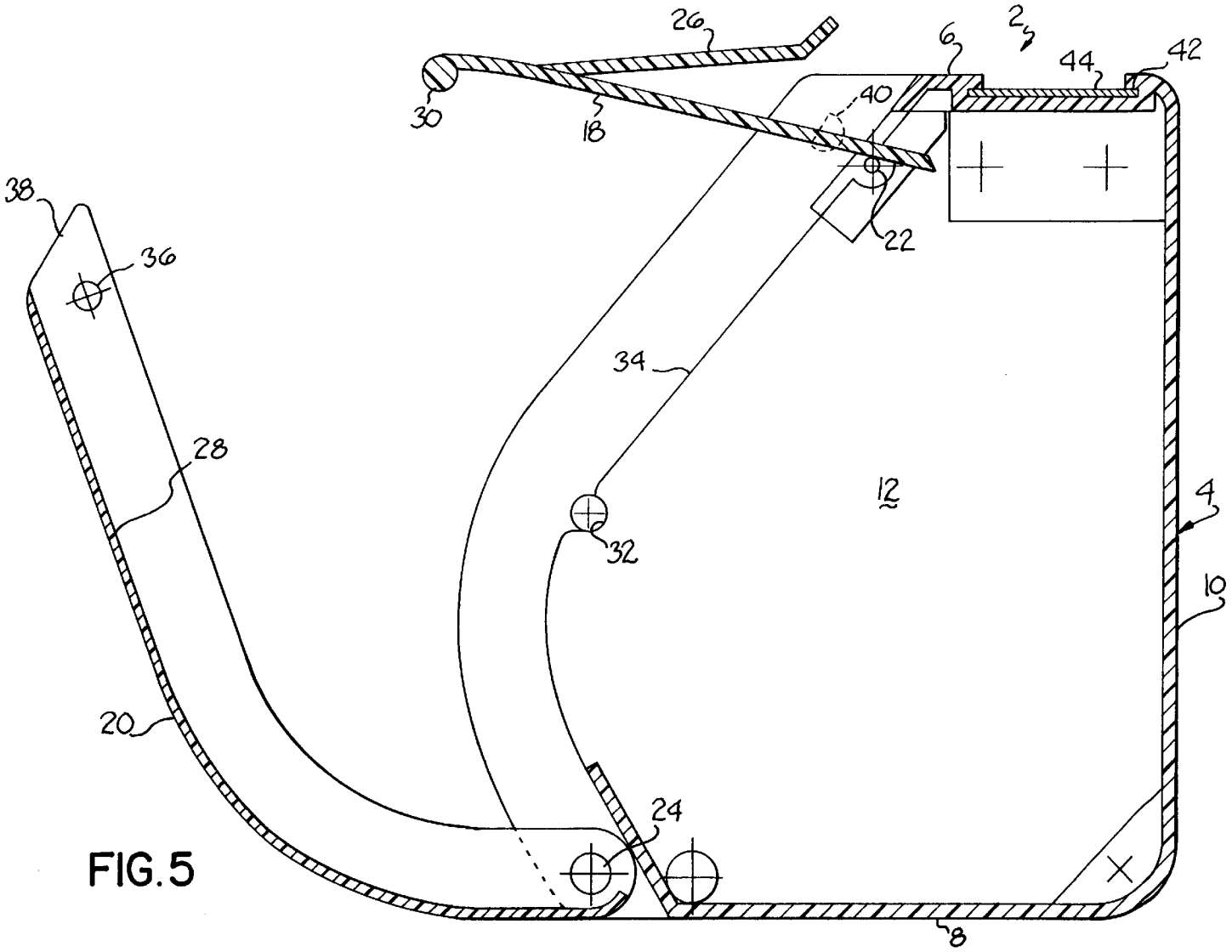
FIG. 5 is a view similar to FIG. 2 but opened to insert a product.

Referring to FIGS. 2 and 5, there are shown a top door 18 and a bottom door 20 that are pivotally connected to the side walls 12 and 14 by pivot pins 22 and 24. In a closed position as shown in FIGS. 1 and 2, the top door 18 and bottom door 20 define a dispensing channel 25 for receiving the roll/strip 16 of the medication pouches as they are dispensed from the container 4. Top door 18 includes a roll/strip engaging member such as a tension arm 26 which is intended to force the roll/strip 16 against the inside or bottom surface 28 of the bottom door 20 when the bottom door 20 is in the closed position as shown in FIG. 2. The tension arm 26 may be spring-biased toward the inside surface 28 of the bottom door 20 or, as shown, is preferably made of a strip of flexible material which is connected to the top door 18 at one end and resiliently engages the roll/strip 16 at a free end. The end 30 of the top door 18 is rounded and engages a notch 32 in a flange wall 34 which is on the inside of each side wall 12 and 14. A snap lock is thus provided to hold the top door 18 in place when the roll/strip is being dispensed. Similarly, a detent 36 carried by the bottom door 20 on each side of the top end 38 engages with notches 40 on each side wall 12 and 14 to hold the bottom door 20 in a locked position. Container 4 has a slot 42 functioning as a label holder to receive patient indicia information on a suitable plaque or label 44.

FIG. 5 shows the container with doors 18 and 20 in the open position for accepting a roll/strip 16. Top door 18 would first be closed after the roll/strip 16 is inserted into the cavity of the container. Thereafter, the end of the roll/strip 16 is pulled over the top of the door 18 and the door 20 is then closed to releasably capture the roll/strip 16 between the tension arm 26 and the inside surface 28 of the bottom door 20. Preferably, door 20 is transparent so that any information on the medication pouches may be viewed when door 20 is closed.

In use, a free end of the tension arm 26 transversely bears against the roll/strip 16 to prevent the strip from retracting into the container 4. The next sequenced medication pouch is visible through the transparent door 20. For each dispense of medication, the administrator simply pulls the roll/strip through the dispensing channel 25 and removes the next sequenced medication pouch, while the tension arm 26 retains the next sequenced pouch in the dispensing channel 25. In this way, the dispenser container 4 houses the roll/strip 16 in a manner to insure that the administrator of the medication only has access to the medication pouches in the sequence in which they are intended to be administered.

Figure 6:
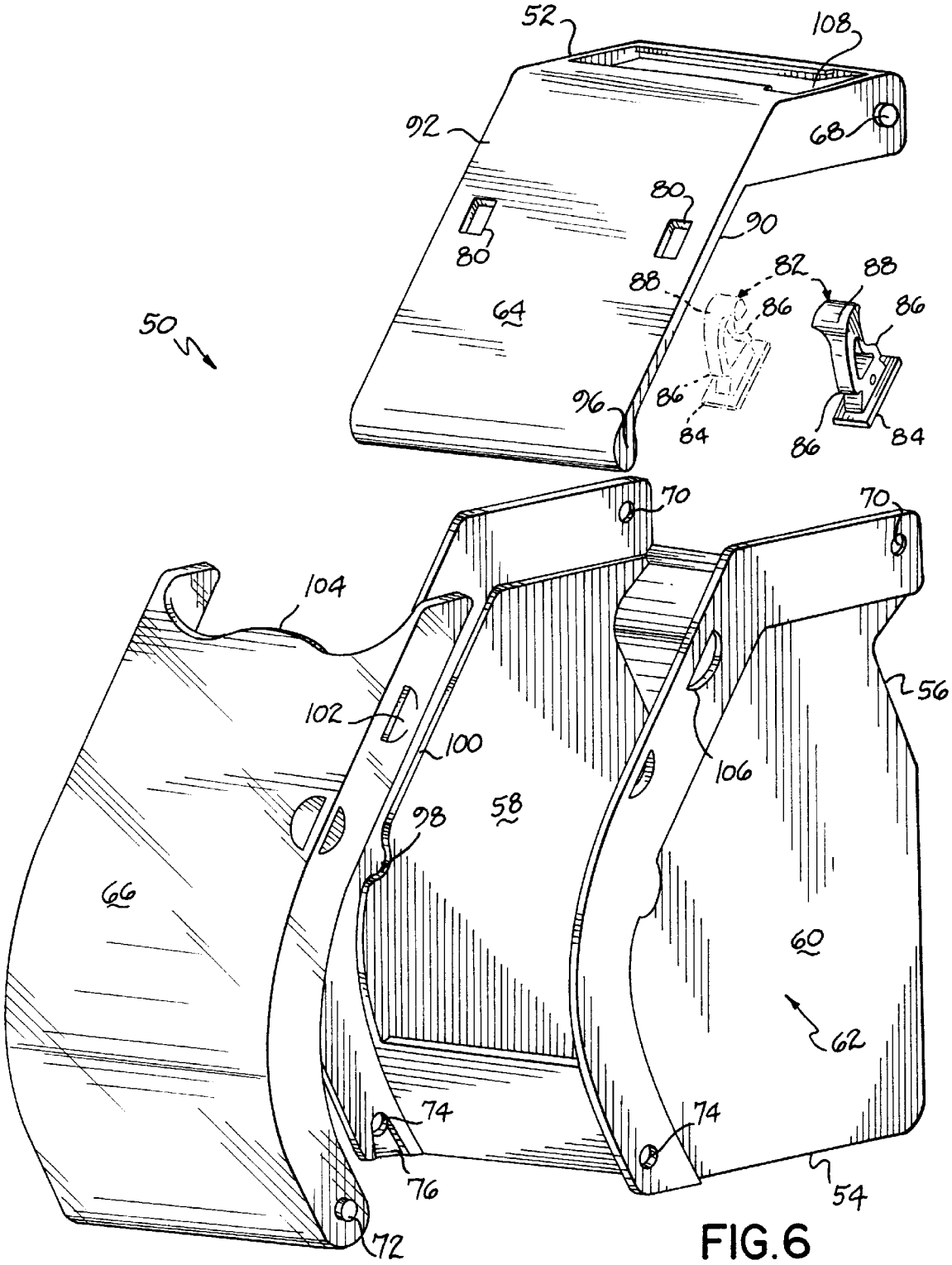
FIG. 6 is a disassembled perspective view of a dispenser in accordance with a second embodiment of the present invention.
Figure 7:
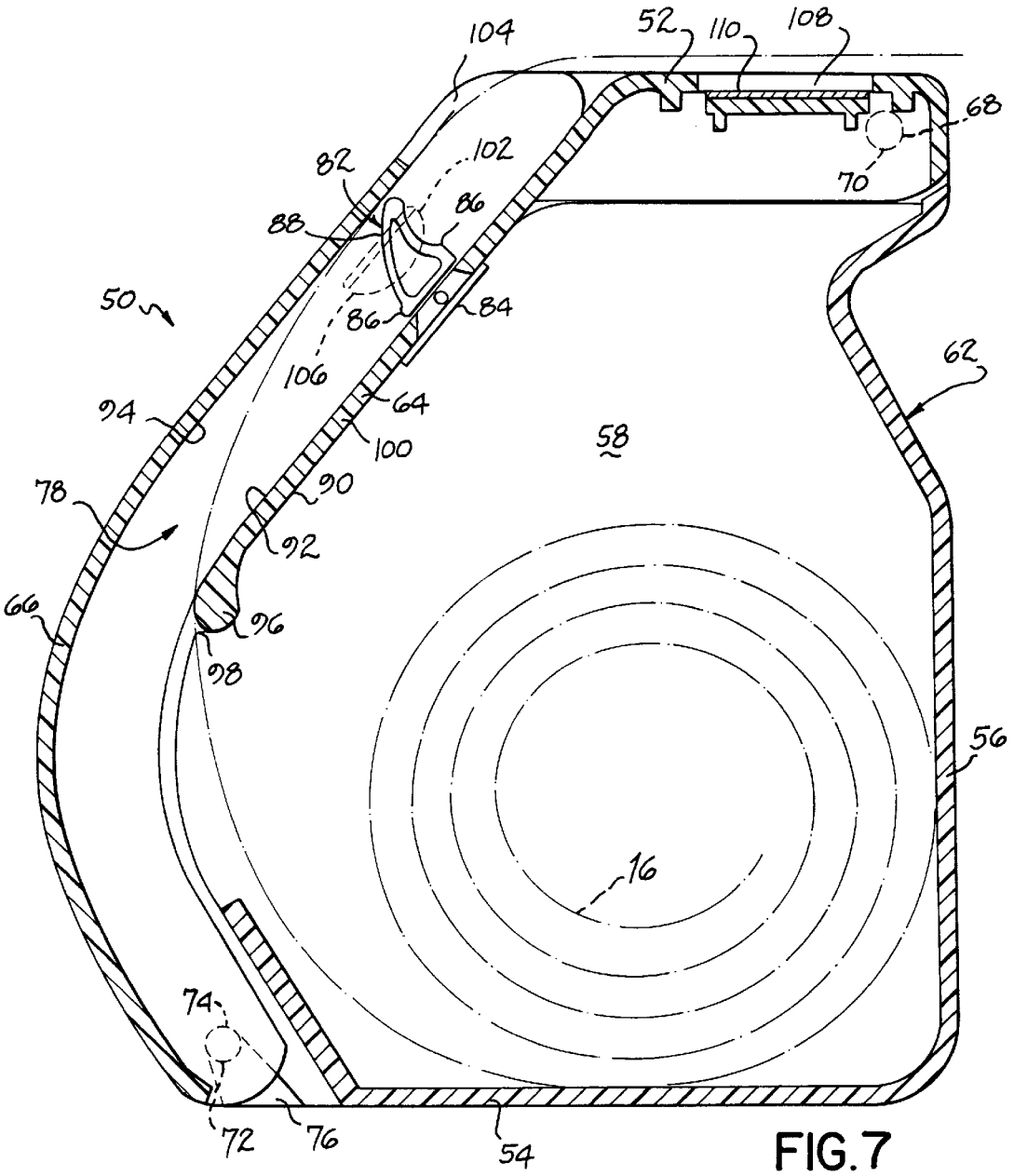
FIG. 7 is a cross-sectional view of the assembled dispenser of the second embodiment.

In a second and perhaps preferred embodiment of the invention as shown in FIGS. 6 and 7, a strip dispenser 50 has a top wall 52, a bottom wall 54, a back wall 56 and side walls 58 and 60, which are preferably integrally formed to define a container 62 for receiving the roll/strip 16. Preferably, the container 62 is made of a suitable plastic material. The strip dispenser 50 has a top door 64 and a bottom door 66 that are pivotally connected to side walls 58 and 60. Top door 64 has a pair of outwardly directed pivot lugs 68 that are received in apertures 70 formed in the side walls 58 and 60. Likewise, bottom door 66 has a pair of outwardly directed pivot lugs 72 that are received in apertures 74. Preferably, at least one of the apertures 74 includes a recessed channel 76 to guide a respective pivot lug 72 into the aperture 74 during assembly of the strip dispenser 50. Likewise, while not shown, at least one of the apertures 70 may also have a recessed channel to guide a respective pivot lug 68 into an aperture 70 in the same manner. Moreover, those skilled in the art will appreciate that one or both pairs of the pivot lugs 68 and 72 could be replaced with a continuous pin as described in detail above with respect to the pivot pins 22 and 24 of strip dispenser 2 shown in FIGS. 1–5 without departing from the spirit and scope of the present invention.

In a closed position as shown in FIG. 7, the top door 64 and bottom door 66 define a dispensing channel 78 for the roll/strip 16 of medication pouches as they are dispensed from the container 62. Top door 64 preferably includes a pair of apertures 80 for receiving and retaining respective roll/strip engaging members or retainers 82 proximate lateral edges of the top door 64. Each retainer 82 is preferably made of a resilient material such as rubber, for example, and includes a base 84, opposing flanges 86 and a tapered roll/strip engaging surface 88.

In use, one of the retainers 82 is inserted into a respective aperture 80 in the top door 64. The base 84 engages an inner or bottom surface 90 of the top door 64 while the opposing flanges 86 engage an outer or top surface 92 of the top door 64 to positively engage the retainer 82 in the aperture 80. Each retainer 82 is intended to force a lateral edge of the roll/strip 16 against the inside or bottom surface 94 of the bottom door 66 when the door 66 is in the closed position as shown in FIG. 7. The roll/strip 16 may have a knurled or textured surface along one or both of its lateral edges (not shown) to frictionally cooperate with the roll/strip engaging surface 88 of a retainer 82. It is contemplated that only one retainer 82 is required to prevent the roll/strip 16 from accidently retracting into the container 62. Thus, both apertures 80 are provided in the top door 64 to permit left-side or right-side mounting of a retainer 82 to accommodate for a particular dispensing application or requirement.

The end 96 of the top door 64 is rounded and cooperates with a notch 98 in a flange wall 100 which is on the inside of each side wall 58 and 60. The notch 98 and flange wall 100 define the closed position of the top door 64 as shown in FIG. 7. A detent 102 carried by the bottom door 66 on each side of the top end 104 engages with notches 106 on each side wall 58 and 60 to hold the bottom door 66 in a closed position. Container 62 has a slot 108 functioning as a label holder to receive patient indicia information on a suitable placque or label 110. Preferably, bottom door 66 is transparent so that any information on the medication pouch may be viewed with the door 66 closed.

From the above disclosure of the general principles of the present invention and the preceding detailed description of a preferred embodiment, those skilled in the art will readily comprehend the various modifications to which the present invention is susceptible. Therefore, Applicant desires to be limited only by the scope of the following claims and equivalents thereof.

Having described the invention, I claim:

1. A dispenser for dispensing articles in a roll/strip form, comprising:

a container having an opening and constructed of preformed, non-folded walls for inserting the articles in roll/strip form into the interior of the container;

a first door pivotally connected to said container at a first location;

a second door pivotally connected to said container at a second location, the first and second doors providing a closure for the opening in a closed position, with one of said doors overlying the other door when both doors are in the closed position;

a dispensing channel between the doors and formed by the doors when in the closed position, whereby the articles are withdrawn from the container through said dispensing channel; and a roll/strip engaging member affixed to one of said first and second doors and extending into said dispensing channel to engage the roll/strip of articles.

2. A front-loading medication strip dispenser for dispensing medication pouches in a roll/strip form, comprising:

a container providing an interior for storage of said medication pouches in roll/strip form, said container having an opening and constructed of preformed, non-folded walls through which said pouches may be introduced into the interior;

first and second doors connected to the container, the first and second doors providing a closure for the opening when in a closed position, with one door overlying the other door when both doors are in the closed position; and a dispensing channel between the doors and formed by the doors when in the closed position, whereby the medication pouches are withdrawn from the container through said dispensing channel.

3. The dispenser of claim 2 wherein at least one of said first and second doors is pivotally hinged at one end thereof to said container.

4. The dispenser of claim 2 wherein each of said first and second doors is pivotally connected to said container at a respective one end thereof.

5. A dispenser for dispensing articles that are linked together in a chain-like form and then rolled up to form a roll, comprising:

a container having an opening and constructed of preformed, non-folded walls for inserting the roll of articles into the interior of the container;

two doors pivotally attached to the container proximate opposite sides of the opening, the two doors providing a closure for the opening when in a closed position, with one door overlying the other door when both doors are in the closed position; and a dispensing channel between the doors and formed by the doors when in the closed position, whereby the articles are withdrawn from the container through said dispensing channel.

6. The dispenser of claim 5 wherein a roll engaging member is affixed to one of said doors to extend into said dispensing channel and engage the roll of articles.

7. The dispenser of claim 6 wherein said roll engaging member comprises a resilient retainer.

8. The dispenser of claim 6 wherein said roll engaging member comprises a tension arm.

9. A front-loading medication strip dispenser for dispensing medication pouches in a roll/strip form, comprising:

a container constructed of preformed, non-folded walls having a top, bottom, sides and a back wall, said container providing an interior for storage of said medication pouches in roll/strip form, said container having an opening through which said pouches are introduced into the interior;

a top door pivotally hinged at one end adjacent to the top of said container, said top door having a top and bottom surface; and a bottom door, pivotally hinged at one end adjacent to the bottom of said container, said bottom door having a top and bottom surface;

said top and bottom doors providing a closure for said opening when in a closed position and defining a dispensing channel for permitting said medication pouches to be dispensed from said container in roll/strip form.

10. The dispenser of claim 9 wherein a tension arm is affixed to said top door to engage the medication pouches in roll/strip form as the medication pouches are dispensed from said container.

11. The dispenser of claim 9 wherein locking elements are provided to releasably connect at least one respective free end of said top and bottom doors to said container.

12. The dispenser of claim 9 wherein a resilient retainer is affixed to said top door to engage the medication pouches in roll/strip form as the medication pouches are dispensed from said container.

13. The dispenser of claim 9 wherein medication pouches in roll/strip form having a free end are positioned within the container and the free end is threaded between the top surface of the top door and the bottom surface of the bottom door.

14. The dispenser of claim 11 wherein the free end of said top door is curved.

15. The dispenser of claim 9 wherein at least a part of the top and bottom surface of said bottom door is transparent.

16. The dispenser of claim 9 wherein the top wall of said container includes a surface for displaying indicia.

17. The dispenser of claim 9 wherein the top wall of said container includes a label holder.

* * * * *